US005989107A

United States Patent [19]

Shimizu et al.

[11] Patent Number: 5,989,107

[45] Date of Patent: Nov. 23, 1999

[54] METHOD FOR POLISHING WORKPIECES AND APPARATUS THEREFOR

[75] Inventors: Noburu Shimizu, Yokohama; Norio Kimura, Fujisawa, both of Japan

[73] Assignee: Ebara Corporation, Tokyo, Japan

[21] Appl. No.: 08/857,252

[22] Filed: May 16, 1997

[30] Foreign Application Priority Data

May 16, 1996 [JP] Japan ..... 8-146776

[51] Int. Cl.[6] ..... B24B 1/00

[52] U.S. Cl. ..... 451/57; 451/285; 451/287

[58] Field of Search ..... 451/57, 63, 41, 451/42, 285, 287, 288, 289, 259, 264, 265, 268, 269, 270, 272, 273, 274, 392, 393, 394, 397, 398, 400, 166; 269/60

[56] References Cited

U.S. PATENT DOCUMENTS

| | | | |
|---|---|---|---|
| 3,638,933 | 2/1972 | Burnette et al. | 269/60 |
| 3,659,386 | 5/1972 | Goetz et al. . | |
| 4,409,860 | 10/1983 | Moriyama et al. | 269/60 |
| 4,617,764 | 10/1986 | Reibakh | 451/5 |
| 4,680,893 | 7/1987 | Cronkhite et al. . | |
| 4,896,869 | 1/1990 | Takekoshi | 269/60 |
| 5,083,401 | 1/1992 | Yamashita et al. | 451/5 |
| 5,184,433 | 2/1993 | Maack | 451/41 |
| 5,228,177 | 7/1993 | Herzog et al. | 29/33 R |
| 5,232,875 | 8/1993 | Tuttle et al. . | |
| 5,551,986 | 9/1996 | Jain . | |
| 5,554,064 | 9/1996 | Breivogel et al. . | |
| 5,620,357 | 4/1997 | Misaka et al. | 451/9 |
| 5,645,466 | 7/1997 | Wikle | 451/5 |
| 5,851,136 | 12/1998 | Lee | 451/9 |

FOREIGN PATENT DOCUMENTS

| | | |
|---|---|---|
| 0 517 594 | 12/1992 | European Pat. Off. . |
| 0 684 634 | 11/1995 | European Pat. Off. . |
| 197 634 | 4/1908 | Germany . |
| 2-208931 | 8/1990 | Japan . |
| 4-69147 | 3/1992 | Japan . |
| 5-74749 | 3/1993 | Japan . |

OTHER PUBLICATIONS

U.S. Patent Application Serial No. 08/697,167, filed Aug. 20, 1996, entitled "Polishing Apparatus", by Tetsuji Togawa et al., located in Group Art Unit 3203.

*Primary Examiner*—Timothy V. Eley
*Assistant Examiner*—Derris Holt Banks
*Attorney, Agent, or Firm*—Wenderoth, Lind & Ponack, L.L.P.

[57] ABSTRACT

A polishing method and a compact apparatus for the method are presented for efficient production of a polished workpiece for manufacturing high technology devices. The polishing method comprises a first and second steps for polishing a work surface. In the first polishing step, the work surface is pressed against an abrading surface of a first polishing tool which is being rotated. In the second step, the work surface is pressed against a rubbing surface of a second polishing tool which is being moved in a planar translation motion relatively to the work surface.

22 Claims, 6 Drawing Sheets

METHOD FOR POLISHING WORKPIECES AND APPARATUS THEREFOR

BACKGROUND OF THE INVENTION

1. Field of the Invention

The present invention relates in general to polishing methods and apparatuses, and relates in particular to a polishing method and a polishing apparatus for processing substrates, such as semiconductor wafers, glass plates and liquid crystal display panels which require a high cleanliness.

2. Description of the Related Art

In recent years, there has been a remarkable progress in the density of integrated circuit devices which leads to a narrower interline spacing of the wiring, and, in the case of using optical lithography involving less than 0.5 mm line spacing particularly, the shallow depth of focus associated with its optics demands extreme flatness at the focusing plane of the stepper. This trend means also that if a particle of a size larger than the line spacing should remain on the fabricated device, it can cause short circuiting which may lead to device failure. Therefore, it is evident that workpiece processing must produce a flat and clean workpiece. These processing requirements apply equally to other workpiece materials in general, such as glass plates for photo-masking or liquid crystal display panels.

FIG. 4 shows a conventional polishing apparatus comprising: a polishing unit 10; a loading/unloading unit 21; a transfer robot 22, and two cleaning machines 23*a*, 23*b*. FIG. 6 is a schematic illustration of the polishing unit 10 comprising a turntable 12 having a polishing cloth 11 attached thereto; and a top ring 13 for holding a workpiece 1 and pressing the workpiece (wafer) 1 onto the turntable 12.

Polishing is carried out by holding a workpiece 1 at the bottom surface of the top ring 13, and pressing the workpiece by means of a vertically movable cylinder onto the polishing cloth 11 mounted on the top surface of the rotating turntable 12. In the meantime, a polishing solution Q is supplied from a delivery nozzle 14 in such a way to retain the solution Q between the bottom surface of the workpiece 1 and the abrading surface of the polishing cloth 11.

The turntable 12 and the top ring 13 are rotated independently at their individual controlled speed. As shown in FIG. 6, the top ring 13 is positioned in relation to the turntable 12, so that the peripheral edge of the workpiece 1 is located at distances "a" and "b", respectively, from the center and the peripheral edge of the turntable 12 so that the entire surface of the workpiece 1 can be polished uniformly at some high rotational speeds. It indicates that the diameter "D" of the turntable 12 is chosen according to the following relation to be more than twice the diameter d of the workpiece 1:

$$D=2(d+a+b)$$

The polished workpiece 1 is processed in the cleaning machines 23*a*, 23*b* through several washing and drying steps, and is transferred onto the loading/unloading unit 21 to be stored in a portable workpiece cassette 24. A scrub washing is used which involves the use of brushes made of nylon or mohair, or a sponge made from polyvinylalcohol (PVA).

The conventional polishing apparatus of the type described above is satisfactory from the standpoint of achieving adequate flatness and efficiency owing to large relative displacements between the turntable 12 and the top ring 13 as well as their high relative speeds; however, surface roughness of the polished workpiece tends to be higher than desirable. To produce a polished workpiece of better surface quality, consideration may be given to using two turntables which are operated by varying the abrading qualities of the polishing cloths, rotational speeds and types of polishing solutions. However, as mentioned above, the diameter of the turntable is larger than twice that of the workpiece diameter, and each apparatus takes up a large floor space area which leads to higher facility costs. These problems becomes more ignorable as the industry seeks larger diameter substrates.

While it is possible to use one turntable to produce a superior surface quality by varying the type of polishing solution and lowering the rotational speed, for example, it is obvious that such an approach leads not only to a potential increase in the cost of polishing solution but to inevitable lowering in the production efficiency due to a prolonged operation.

The conventional method also has some problems in the cleaning process when scrubbing follows the use of abrasive particles, not only because of the inherent difficulties of removing small particles in submicron ranges but also because of the ineffective cleaning when there is a strong affinity between the workpiece and the particles.

Therefore, there has long been a need in the semiconductor device manufacturing industry for an efficient polishing method and facility which would enable to produce substrates of high surface qualities, such as flatness, smoothness and cleanliness, in a compact and low cost apparatus.

SUMMARY OF THE INVENTION

It is an object of the present invention to provide a method for producing a high quality substrate having a high degree of flatness, smoothness and cleanliness, and to present a compact and efficient polishing apparatus including a polishing apparatus designed especially for the method.

The object has been achieved in a method for polishing a workpiece comprising: a first step for polishing a work surface of the workpiece by pressing the work surface against an abrading surface of a first polishing tool which is being rotated; and a second step for processing the work surface by pressing the work surface against a rubbing surface of a second polishing tool which is being moved in a planar translation motion relatively to the work surface.

In the above method, the planar translation motion includes a relative motion of two surfaces of many patterns. The typical pattern is circulative, i.e., repeating itself, and has a circular trace without respective rotation motion. However, it may include a respective rotation of a relatively large period of rotation compared to that of the circulative translation between the two surfaces. The trace of translation motion can be a linear translation pattern, a polygonal pattern or an elliptical pattern, but from the practical standpoint of polishing efficiency and mechanical ease, a circular pattern would be optimum. In the circulative translation motion, all the regions of the workpiece is subjected to a same pattern.

In the present method, a high removal ratio and a high flatness of the workpiece such as a semiconductor wafer is achieved in the first step, by subjecting the workpiece to a highspeed material removal process with the first polishing tool. In the second step, a less aggressive polishing tool is used and the surface processing is carried out at a slower speed to attain a smooth surface on the workpiece, and also any micro-particles which may be adhered to the workpiece are removed. The surface of the workpiece is treated with a solution appropriate to the application; i.e., in the first step, abrasive particles are used while in the second step, purified water or a suitable chemical solution is used. In the second step, abrasive particles are normally not used, and if they are used, a small amount of ultra-fine particles are used, and the pressing pressure is reduced relative to the first step.

An aspect of the method is that in the second step, at least one of the workpiece and the polishing tool is rotated with a period of rotation significantly in excess of a period of the circulative translation motion. Accordingly, the location of contact between the surface to be polished and the rubbing surface is gradually changed so as to lead to an overall uniform polishing of the workpiece.

Another aspect of the method is that, in the second step, purified water is used as a polishing solution. Accordingly, this is the last step before the workpiece is subjected to other device manufacturing steps, so that the cleaning step assures that the micro-particles are thoroughly removed from the workpiece.

The object is achieved in a polishing apparatus designed for the method presented above comprising: a first polishing section having a first polishing tool, the first polishing tool having an abrading surface and being rotatable along the abrading surface, and a pressing device for forcing a work surface of a workpiece against the abrading surface; and a second polishing section having a second polishing tool and a pressing device for forcing the work surface against a rubbing surface of the second polishing tool, the second polishing tool being movable in a planar translation motion relative to the work surface.

According to the apparatus, the second polishing tool is not designed to polish by an rotation motion thereof, but the work surface and the rubbing surface are made to undergo an overall translation motion so as not to provide any stationary contact point between the two surfaces. Using this design, the size of the second polishing unit can be only as large as a sum of the base area plus the area of translation motion, thereby presenting a compact polishing unit. The result is that a small drive motor is sufficient, and the floor space required can also be reduced. These advantages become more important as the size of the workpiece to be polished increases. Further, because the second polishing unit does not need to rotate, relative polishing speed in all regions of the workpiece is the same, and flatness can readily be produced, and smoothness can be achieved relatively quickly.

In another aspect of the invention, a polishing apparatus comprises: a support base; a support section for supporting the second polishing tool so as to enable a circulative translation motion; and a driving device to enable the support section to maintain the circulative translation motion.

The support section may comprise a surface plate having a tool attachment surface. The support section may support the surface plate at not less than three locations around a periphery of the surface plate, so that the workpiece can be supported stably under a pressing pressure so as to improve the flatness of the workpiece.

Another aspect of the apparatus presented above is that the support section comprises a connecting member having a pair of shafts, each having an axis which is displaced from each other, so as to enable each shaft to be located in a respective cavity formed on the surface plate and on the support base. Accordingly, a simple coupling is sufficient to produce effective polishing action.

Another aspect of the apparatus presented above is that the surface plate includes a polishing solution supply passage opening at the top surface. Accordingly, every region of the workpiece, including the central region, can be supplied with the polishing solution to effect efficient polishing.

Another aspect of the apparatuses presented above is that the driving device comprises a driving end member having an axis displaced with respect to a rotational axis of a drive source of the driving device and the surface plate comprises a cavity for operatively coupling with the driving end member. Accordingly, the translation motion can be achieved through a simple coupling arrangement.

DESCRIPTION OF THE PREFERRED EMBODIMENTS

Figure 1:
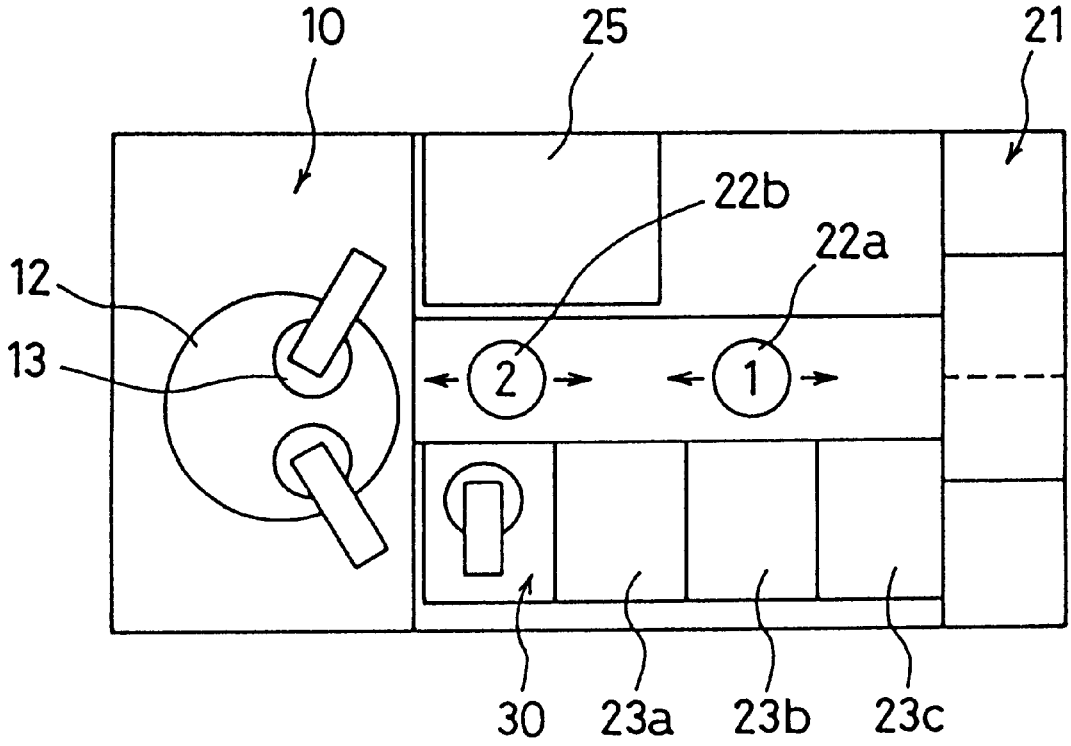
FIG. 1 is an overall plan view of the arrangement of the polishing apparatus of the present invention.

FIG. 1 shows an embodiment of the arrangement of the component units in the polishing apparatus of the present invention. At one end of a rectangular shaped floor space, there is a loading/unloading unit 21 for delivery of workpieces which are to be polished or already polished. At the opposite end of the floor space, there is a main polishing unit (a first polishing section) 10 having a turntable and a top ring. These two units 10, 21 are connected with a workpiece transport route for two robotic transport devices 22*a*, 22*b* in this embodiment, and at a lateral side of the transport route adjacent to the main polishing unit 10, there is a workpiece inverter 25 for turning over a workpiece, and on the opposite lateral side, there are disposed a finish polishing unit (a second polishing section) 30 and three cleaning machines 23*a*, 23*b* and 23*c*. The main polishing unit 10 is provided with one turntable 12 and two top rings 13, and is capable of parallel processing of two workpieces, but other features are the same as those in the conventional polishing apparatus referred to in FIGS. 4, 5.

Figure 2:
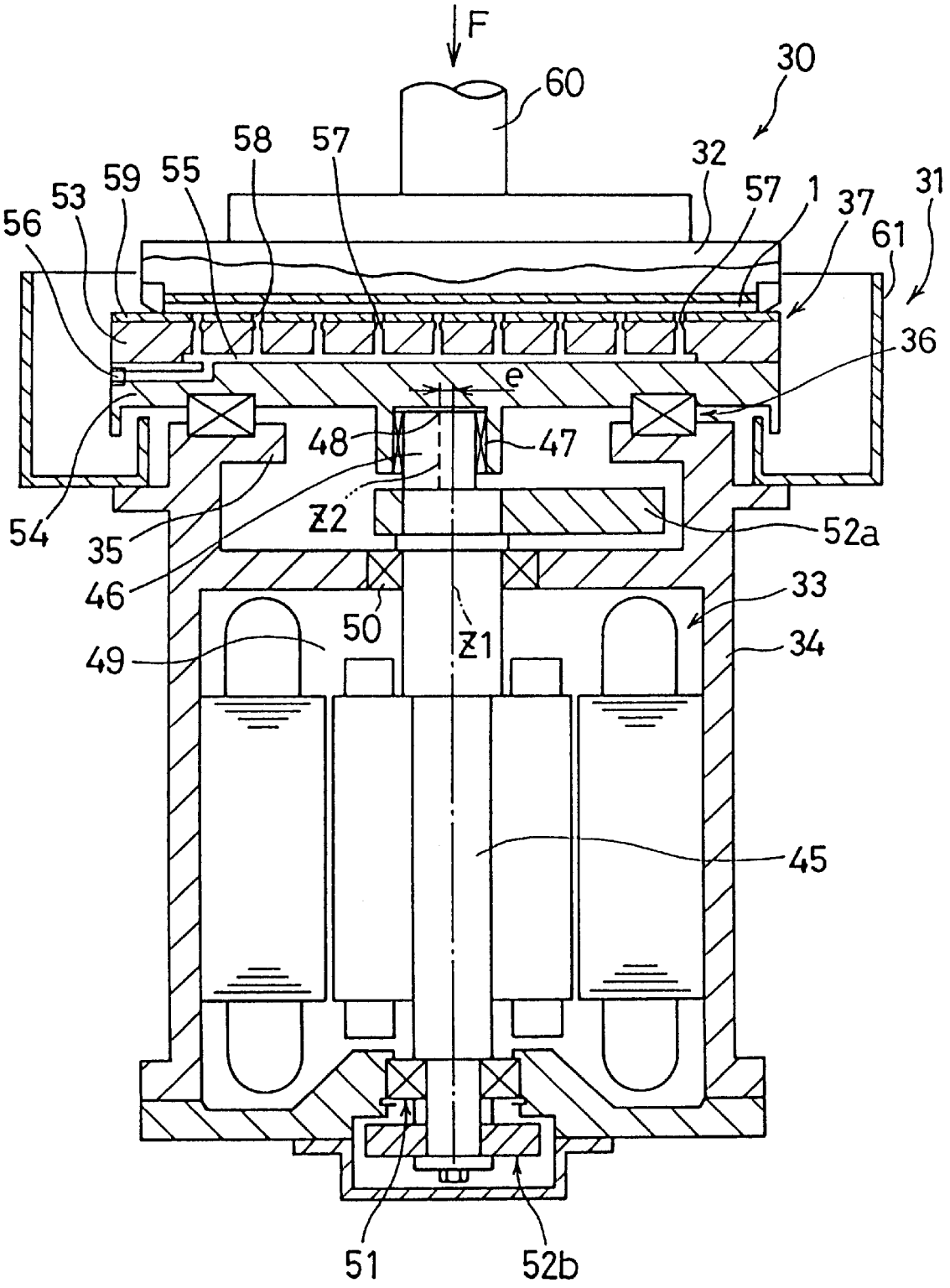
FIG. 2 is a cross sectional view of a finish polishing unit.
Figure 3A:
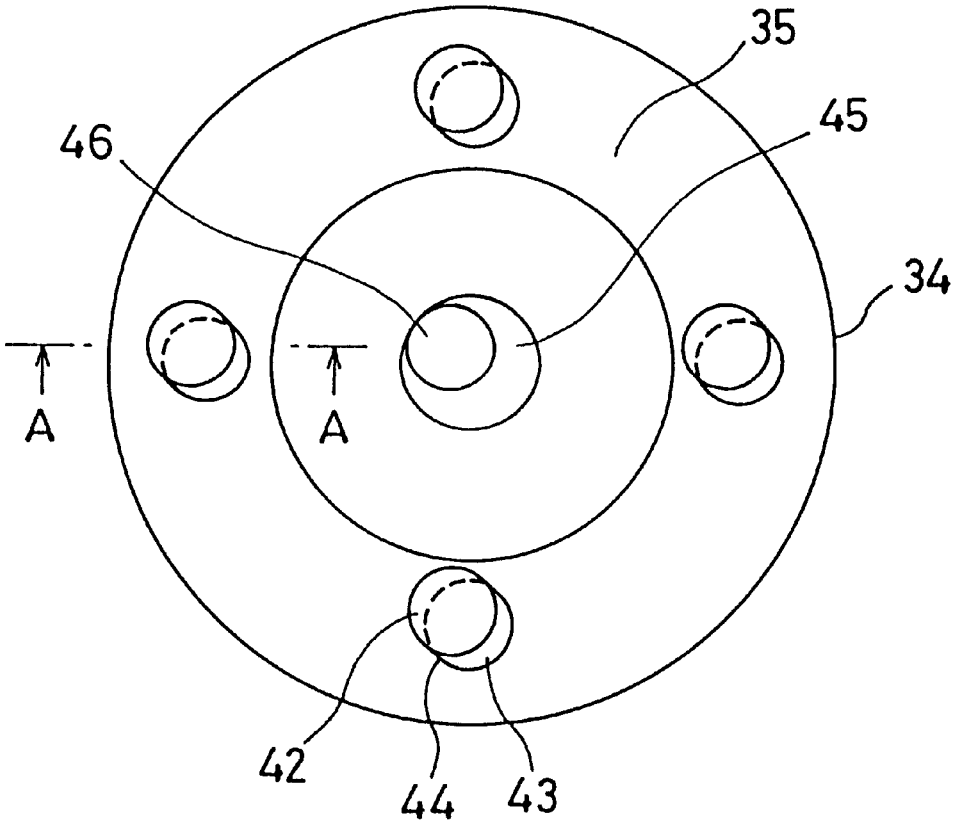
FIG. 3A is a plan view of the surface plate shown in FIG. 2 looking towards the drive motor of the polishing apparatus.

The construction of the finish polishing unit 30 will be described with reference to FIGS. 2, 3. The finish polishing unit 30 comprises a translation table section 31 which provides a circulative translation motion of the abrading surface of the polishing tool, and a top ring 32 for holding the workpiece 1 to direct its surface to be polished downwards and pressing the workpiece 1 onto the abrading surface with a given pressure.

Figure 3B:
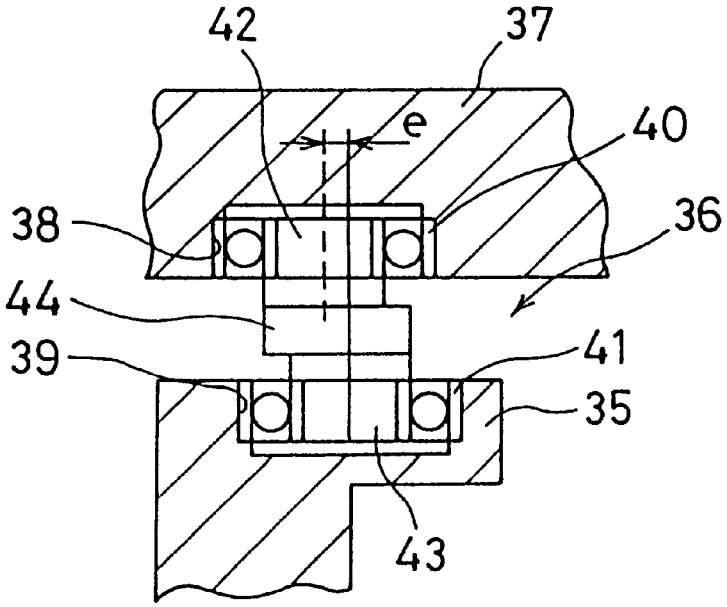
FIG. 3B is a cross sectional view of the surface plate shown in FIG. 2.

The translation table section 31 comprises: a cylindrical casing 34 housing a motor 33 therein; an annular overhang plate section 35 protruding inwards at an upper portion of the cylindrical casing 34; three support sections 36 formed around the circumference of the overhang plate section 35; and a surface plate 37 supported on the support sections 36 and mounted with a polishing cloth (polishing tool) 59 attached thereon. As shown in FIG. 3B, the upper surface of the overhang plate section 35 and the bottom surface of the surface plate 37 respectively include a plurality of cavity sections 38, 39 which are equally spaced apart in the circumferential direction, together with corresponding bearings 40, 41 disposed therein. These bearings 40, 41 are respectively supporting each end portion of the upper and lower shafts 42, 43 of each of the three connecting members 44. The center of the upper shaft 42 of each connecting members 44 is displaced from the center of the lower shaft 43 by an eccentricity distance "e", as shown in FIG. 3, thereby permitting the surface plate 37 to undergo a circulative translation motion over a distance of radius "e".

A cavity section 48 is provided in the central region of the bottom surface of the surface plate 37 for housing a drive bearing 47 for supporting the drive end 46 which is formed at a top surface of the main shaft 45 of the drive motor 33, whose axis $Z_2$ is displaced with respect to the axis $Z_1$ of the main shaft 45. The amount of offset is also "e". The drive motor 33 is housed in the motor chamber 49 provided in the casing 34, and its main shaft 45 is supported by the top and bottom bearings 50, 51. A pair of balancers 52*a*, 52*b* are provided for the purpose of dynamic compensation for the eccentric loading.

The radius of the surface plate 37 is chosen to exceed the sum of the offset radius "e" plus the radius of the workpiece to be polished, and is constructed by overlaying two pieces of disc members 53, 54. A fluid passage 55 for carrying the polishing solution is formed between the overlaid two discs 53, 54, which communicates with a polishing solution entry opening 56 provided on the lateral side of the surface plate 37 as well as with a plurality of polishing solution supply openings 57 opening at the upper surface of the disc 53. The polishing cloth 59 which is attached to the top surface of the surface plate 37 is also provided with a plurality of holes 58 to correspond with the polishing solution supply openings 57. The holes are generally uniformly distributed across the entire surface of the surface plate 37. It is feasible to provide a series of fluid flow grooves on the polishing cloth 59 in a pattern of lattices, spirals or radials which are communicated with the solution supply openings 58.

The top ring 32 serves as a pressing device for the workpiece 1 onto the translation table 31 and is attached to the bottom of a shaft 60 so as to permit a free tilting within a certain degree by way of a joint. The compression force exerted by an unshown air cylinder as well as the rotational force exerted by a motor are transmitted to the top ring 32 through the shaft 60. The top ring 32 is constructed similarly to those shown in FIGS. 4, 5, except that this top ring 32 rotates at a slower speed. On the outer top side of the casing 34, there is a solution collection tank 61 to collect the polishing solution supplied.

Figure 6:
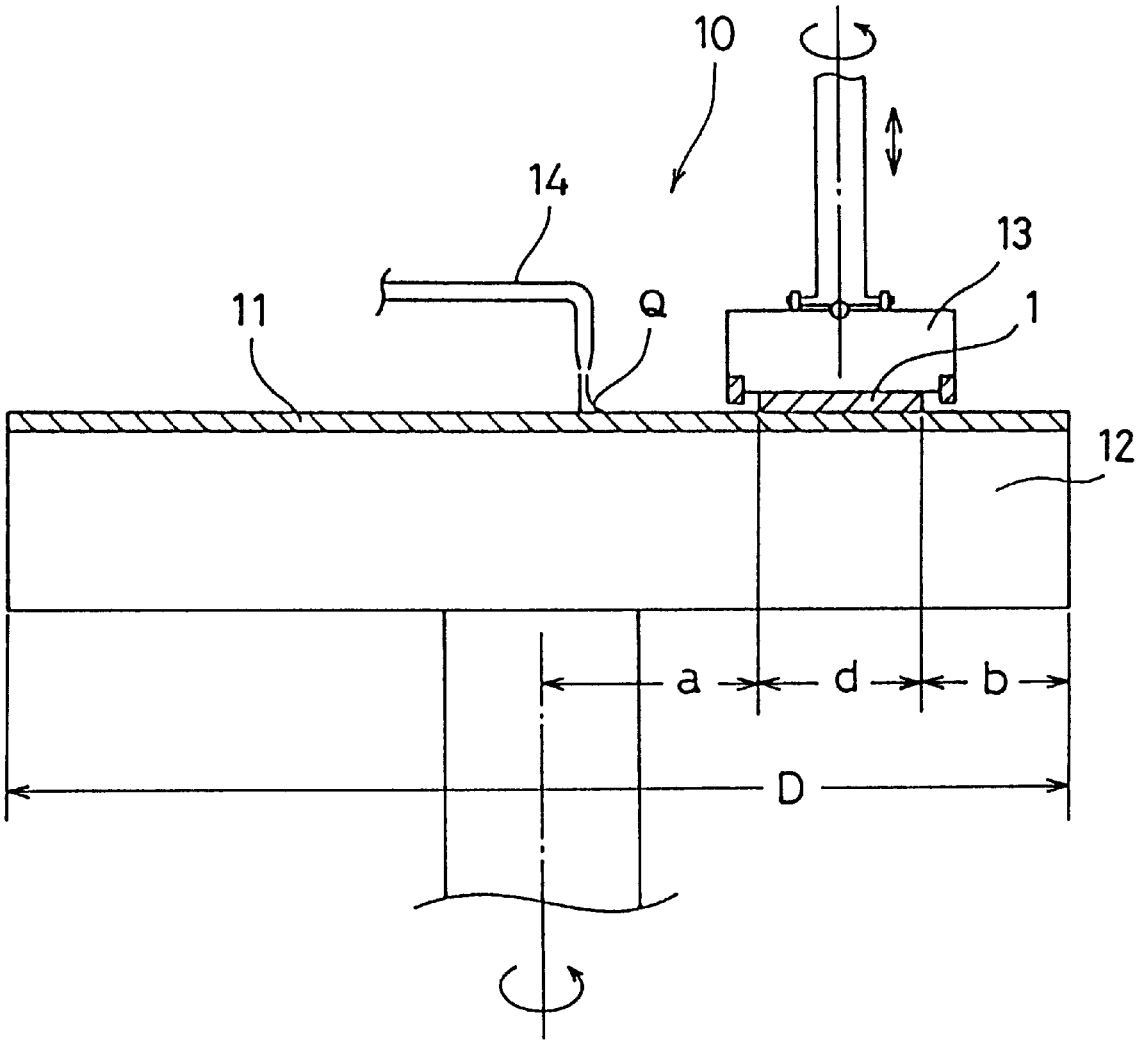
FIG. 6 is a cross sectional view of a conventional polishing unit.

The operation of the polishing apparatus presented above will be described hereinafter. The workpieces 1 in the workpiece storage cassette 24 (see FIG. 4) are attached to each of the top rings 13 of the main polishing unit 10 by the transport robots 22*a*, 22*b*, by way of the inverter 25 when necessary. As shown in FIG. 6, the top ring 13 rotates while pressing on the workpiece 1 onto the polishing cloth 11 mounted on the turntable 12. A first step polishing is carried out by the actions of the highspeed relative movement between the workpiece 1 and the polishing cloth 11, and of the chemical effects produced by the polishing solution Q supplied from the delivery nozzle 14.

The workpiece 1 which has completed the first polishing step is, either directly or after a rough cleaning step, transferred to the finish polishing unit 30 to be subjected to the second polishing step. Here, the surface plate 37 undergoes a circulative translation motion, and the workpiece 1 held by the top ring 32 is pressed onto the rubbing surface of the polishing cloth 59 attached to the surface plate 37.

Finish polishing is provided by using the polishing solution Q supplied through the polishing solution supply openings 56, fluid passages 55 and through the solution supply openings 57, 58, to reach the surface of the workpiece 1 being polished. The action of the minute circulative translation motion of radius "e" between the workpiece 1 and the rubbing surface of the polishing cloth 59 produces a uniform polish on the entire surface to be polished of the workpiece 1.

When the workpiece 1 is processed by the polishing cloth 59 in a same relative positioning to each other, it causes some problems introduced by local differences in the surface conditions of the polishing cloth 59, and to avoid such problems, the top ring 32 is rotated slowly so as to cancel the local difference effect.

In the first polishing step, the workpiece 1 and the polishing cloth 11 are moved in relation to each other at high speeds under a relative high pressing force so as to produce a certain amount of workpiece material removal. In the second polishing step, the purpose is to improve the surface flatness and smoothness as well as to remove micro-particles adhering to the workpiece 1, and to this end, the roughness of the polishing cloth 59 is reduced, and the speed of relative movement and pressing force are also reduced compared with those in the first polishing step. Also, the polishing in the second polishing step is normally carried out using purified water, and chemicals and special slurries are used only when it is necessary.

The workpiece 1, which has been processed through the second polishing step, is subjected to several cleaning steps, as necessary, in the cleaning machines 23*a*~23*c*, and is stored in the workpiece cassette 24. In this embodiment of the polishing apparatus, since two top rings 13 are provided on the main polishing unit 10, by setting the polishing duration in the second polishing step to be one half of that in the first polishing operation, each apparatus can be operated without loss time thereby at its optimum processing efficiency.

Figure 4:
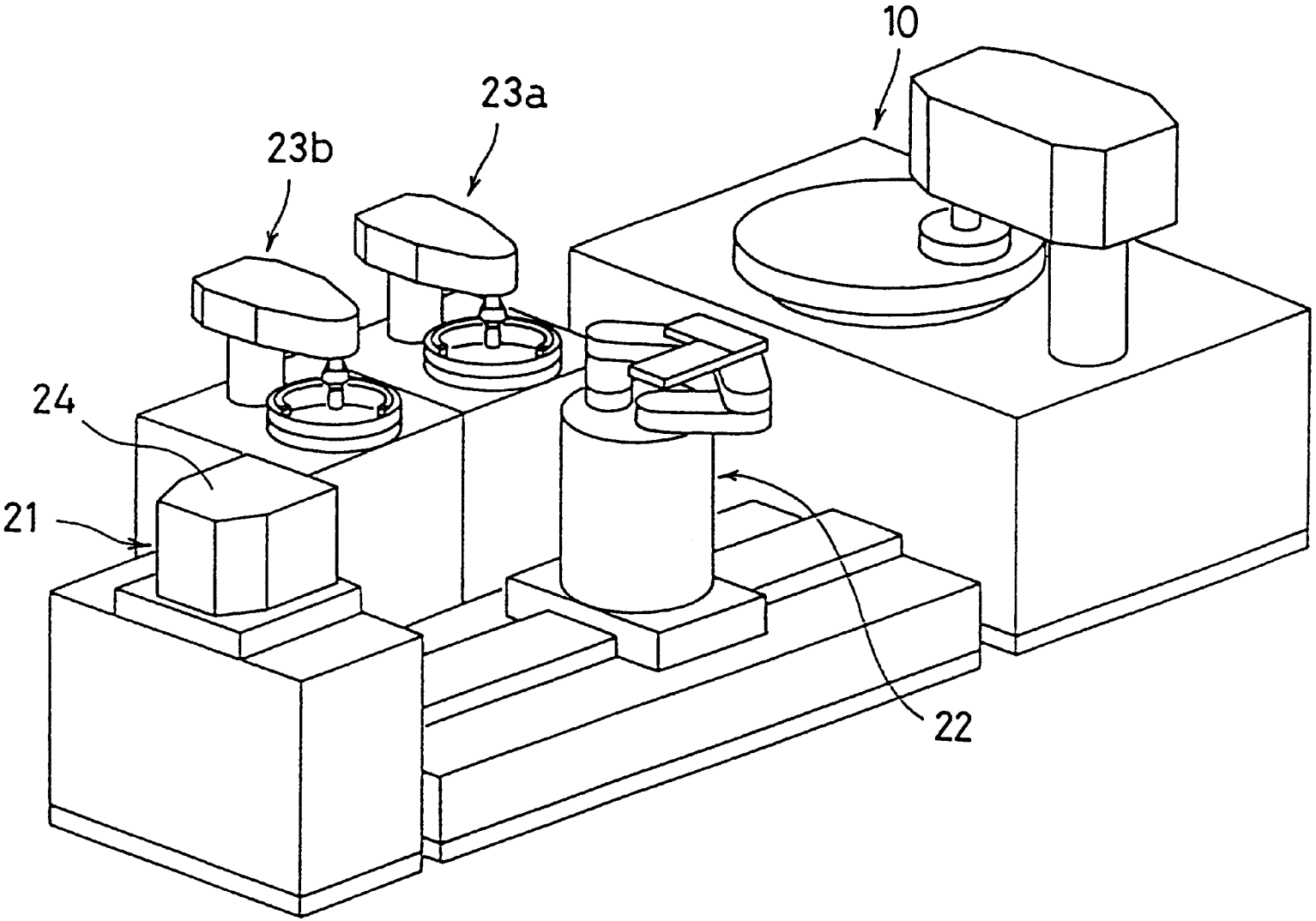
FIG. 4 is a perspective view of a conventional polishing apparatus.
Figure 5:
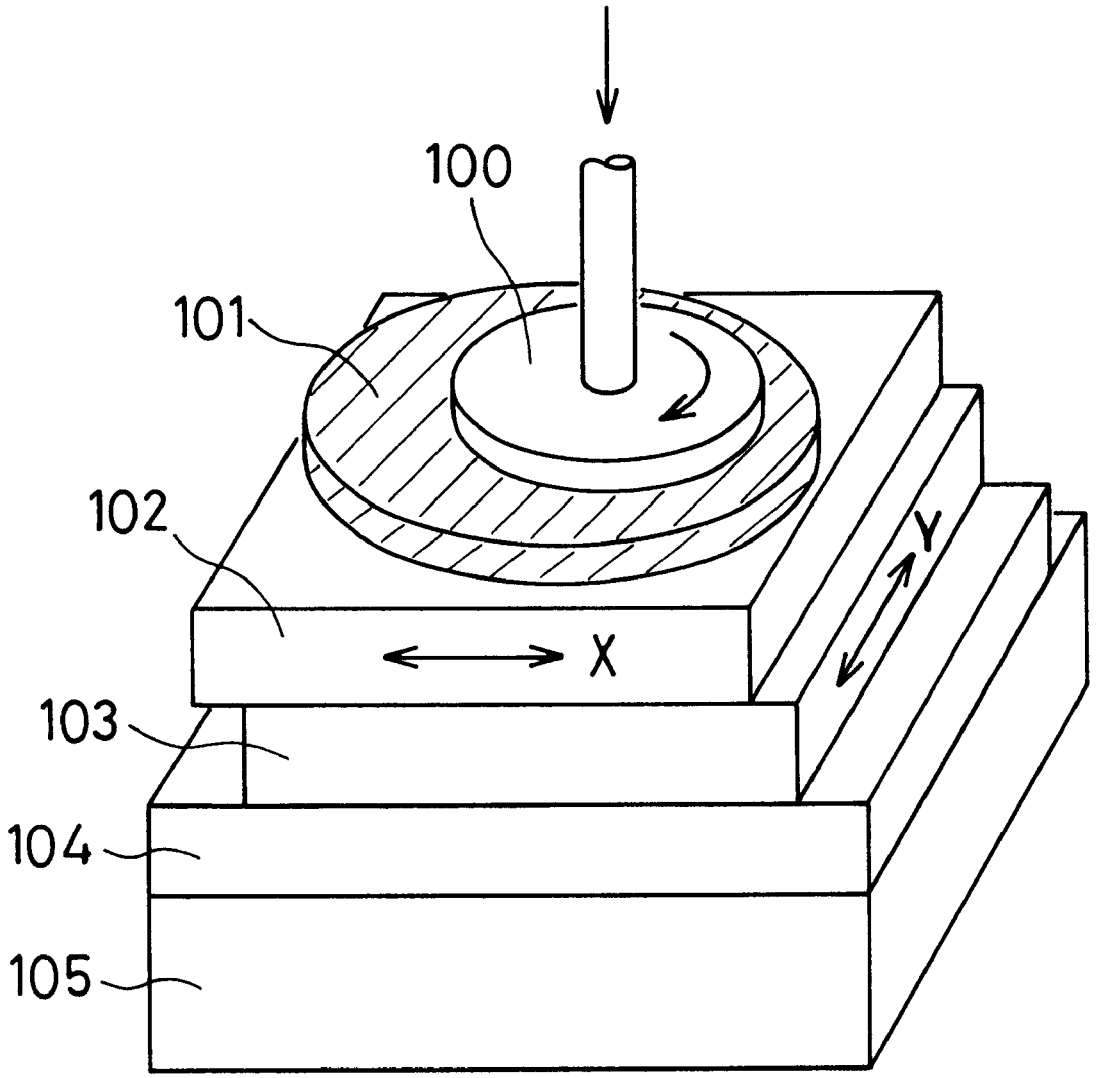
FIG. 5 is a cross sectional view of another embodiment of the finish polishing unit.

In this polishing apparatus, since the polishing process is carried out in two stages which are being carried out simultaneously, the time duration in the first polishing step can be reduced, so that the process throughput is increased compared to the rate achievable with the conventional polishing apparatus shown in FIGS. 4, 5. Also, because the finish polishing unit 30 is a circulative translation type, the size of the surface plate 37 only needs to be larger than the size of the workpiece 1 by the amount of the twice of offset "e". Therefore, compared with a polishing apparatus having two turntables of the same size as the main polishing unit 10, the required floor space is reduced significantly. Further, because the finish polishing unit 30 is based on circulative translation motion, it is possible to design the support structure at several locations along the peripheral edges of the surface plate 37, as shown in FIG. 2, so that the improved flatness is achievable due to the stable supporting mechanism of the surface plate 37 compared with high rotational speed turntables.

In the following, some of the typical operating parameters in the first and second polishing steps are compared.

| | |
|---|---|
| First Polishing Step | |
| Polishing solution | depends on material to be polished |
| Polishing cloth | depends on material to be polished |
| Pressing pressure | 200~500 g/cm$^2$ |
| Relative speed | 0.07~0.6 m/sec |
| Polishing duration | depends on material removal requirement |
| Second Polishing Step | |
| Polishing solution | water, chemicals, or slurry |
| Polishing cloth | soft cloth (non woven fabric, laminated nap) |
| Pressing pressure | 0~200 g/cm$^2$ |
| Relative speed | 0.07~0.6 m/sec |
| Polishing duration | 10~120 sec |

In the above embodiment of the finish polishing unit 30, the polishing tool 59 is made to undergo a circulative translation motion but it is also permissible to arrange so that the top ring 32 for holding the workpiece is made to undergo the same motion while the polishing tool 59 is kept stationary. Also, crank type of connecting members 44 were used in the support sections 36 to connect to the surface plate, but it is permissible to use other types of support systems such as magnetic bearings and dry roller bearings, so long as they can provide translation movement of the surface plate 37 while inhibiting its free-rotation.

Also, in this embodiment, the circulative translation motion was produced by an "eccentric" design provided at the end of the drive shaft of the motor, but other designs, for example, such as a so-called "X-Y stage" movable in the X- and Y-directions may be utilized to produce a translation motion of a similar trace as a vector sum for the surface plate 37.

FIG. 5 shows an embodiment of a polishing apparatus of this type comprising a top ring 100 for mounting a workpiece on the lower surface thereof, and a polishing tool 101 arranged beneath the top ring 100 and attached to the X-Y stage. In this embodiment, an electro plated grindstone is utilized as a polishing tool of a relatively small abrasive grain size. The X-Y stage comprises an X-stage 102, a Y-stage 103 and a fixing plate 104 which are overlaid in the order and mounted on a base 105. Between the X-stage 102 and the Y-stage 103 are provided a linear guide mechanism and a linear driving mechanism such as a feed screw so as to make the X-stage 102 movable in the X direction. The same mechanisms are provided between the Y-stage 103 and the fixing plate 104, and a controller device is provided for controlling these X- and Y- direction driving mechanism.

In the present embodiment, by applying a displacement having a sine- and a cosine-wave of a same phase to the X-stage 102 and the Y-stage 103 respectively, the X-stage 102 will conduct a circular translation motion as a sum vector of both direction movements. Thus, the polishing tool 101 undergoes a circulative translation motion as in the first embodiment of the invention. It is preferable to rotate the top ring 100 with a period of rotation significantly in excess of a period of the circulative translation motion of the tool 101 in order to eliminate the effect resulting from a local difference of surface condition of the tool.

This embodiment, since a mechanical "eccentric" design is not used, has an advantage of having more degrees of freedom in changing the trace of the circulative translation motion. For example, since it is possible to change the diameter of the circular translation motion without stopping the operation, the polishing motion during the polishing step of a workpiece can be changed so as to polish with a smaller diameter in the starting and ending period than in the usual polishing period. By applying such a control method, it can avoid the deteriorative effects caused by the localized condition differences on the polishing tool surface, such as a unidirectional scar, when repeating a simple circulative motion.

This embodiment can create not only a circular motion but also any other type of circulative translation motion such as, an ellipsoidal motion, an eight-shape (8) motion or an oscillating spiral motion, or any kind of combination thereof. Further, this embodiment can create not only a circulative motion having a certain trace but also a totally random translation motion which is by no means circulative. This intentional randomization of the relative translation motion can be performed by using a random number generation function of a computer processor, for example. In this case, it is preferable to retain a minimum radius of curvature of the trace in order to keep a smooth motion.

It has thus been demonstrated in the present method that by dividing the polishing process into two stages, first and second polishing steps, it is possible to produce a high degree of flatness and smoothness on workpiece. In the first polishing step, the workpiece and the polishing tool are moved relative to each other at relatively high speeds to produce flatness on the workpiece. This is followed by a second step to obtain smooth surface on the workpiece by using a polishing tool having a lesser abrasive quality and providing a relatively small degree of relative motion between the workpiece and the polishing tool. The polishing process is completed by removing micro-particles which may be adhering to the workpiece, to produce a workpiece having a high degree of flatness, smoothness and cleanliness.

It has also be demonstrated that, since the second polishing unit of the present invention undergoes a circulative translation motion, the size of the apparatus can be small enough to be slightly larger than the workpiece by the distance of eccentricity to enable a compact apparatus to be presented. Additional benefit is that the drive motor can be small and the occupied floor space is also small. The surface plate is supported at more than three locations around the periphery of the surface plate so that the application of the pressing force does not affect the stability of supporting member and the flatness of the polished surface can be maintained.

What is claimed is:

1. A method for polishing a workpiece comprising:

a first step for polishing a work surface of said workpiece by pressing said work surface against an abrading surface of a first polishing tool which is being rotated; and a second step for processing said work surface by pressing said work surface against a rubbing surface of a second polishing tool which is being moved in a planar translation motion relatively to said work surface.

2. A polishing method according to claim 1, wherein, in said second step, said relative translation motion is a circulative motion having a certain pattern.

3. A polishing method according to claim 2, wherein, in said second step, at least one of said workpiece and said polishing tool is rotated with a period of rotation significantly in excess of a period of said circulative translation motion.

4. A polishing method according to claim 1, wherein, in said second step, said relative translation motion is provided by moving said second polishing tool.

5. A polishing method according to claim 1, wherein, in said second step, said relative translation motion is a random motion.

6. A polishing method according to claim 5, wherein, in said second step, said random relative translation motion is provided as a sum vector of at least two linear motion.

7. A polishing method according to claim 1, wherein a pressing pressure for pressing said work surface against an abrading surface of said first polishing tool is 200~500 g/cm$^2$ and a pressing pressure for pressing said work surface against an rubbing surface of said second polishing tool is 0~200 g/cm$^2$.

8. A polishing method according to claim 1, wherein, in said second step, purified water is used as a polishing solution.

9. A polishing apparatus comprising:

a first polishing section having a first polishing tool, said first polishing tool having an abrading surface and being rotatable along said abrading surface, and a pressing device for forcing a work surface of a workpiece against said abrading surface; and a second polishing section having a second polishing tool and a pressing device for forcing said work surface against a rubbing surface of said second polishing tool, said second polishing tool being movable in a planar translation motion relative to said work surface.

10. A polishing apparatus according to claim 9, wherein said second polishing section comprises: a support section for supporting said second polishing tool so as to enable a circulative translation motion; and a driving device to enable said support section to maintain said circulative translation motion.

11. A polishing apparatus according to claim 10, wherein said driving device comprises a driving end member having an axis displaced with respect to a rotational axis of a drive source of said driving device and said support section comprises a cavity for operatively coupling with said driving end member.

12. A polishing apparatus according to claim 9, wherein a pressing pressure for pressing said work surface against an abrading surface of said first polishing tool is 200~500 g/cm$^2$ and a pressing pressure for pressing said work surface against an rubbing surface of said second polishing tool is 0~200 g/cm$^2$.

13. A polishing apparatus comprising: a support base; a surface plate having a top surface for attaching a polishing tool; a support section for supporting said surface plate so as to enable a circulative translation motion; and a driving device to enable said surface plate to maintain said circulative translation motion.

14. A polishing apparatus according to claim 13, wherein said support section supports said surface plate at not less than three locations around a periphery of said surface plate.

15. A polishing apparatus according to claim 13, wherein said support section comprises a connecting member having a pair of shafts, each having an axis which is displaced from each other, so as to enable each shaft to be located in a respective cavity formed on said surface plate and on said support base.

16. A polishing apparatus according to claim 13, wherein said surface plate includes a polishing solution supply passage opening at said top surface.

17. A polishing apparatus according to claim 13, wherein said driving device comprises a driving end member having an axis displaced with respect to a rotational axis of a drive source of said driving device and said surface plate comprises a cavity for operatively coupling with said driving end member.

18. A polishing apparatus comprising: a support base; a surface plate having a top surface for attaching a polishing tool; a first support section for supporting said surface plate so as to enable a linear translation motion in a first direction; a second support section for supporting said first support section so as to enable a linear translation motion in a second direction different to said first direction and driving means for driving said surface plate and said first and second support sections to maintain said linear translation motion.

19. A method for polishing a workpiece comprising:

a first step for polishing a work surface of said workpiece by pressing said work surface against an abrading surface of a first polishing tool which is being rotated; and a second step for processing said work surface by pressing said work surface against a rubbing surface of a second polishing tool which is substantially being moved in a planar translation motion relative to said work surface.

20. A polishing method according to claim 19, wherein, said second polishing tool is moved substantially without relative rotation to said work surface.

21. A polishing apparatus comprising:

a first polishing section having a first polishing tool, said first polishing tool having an abrading surface and being rotatable along said abrading surface, and a pressing device for forcing a work surface of a workpiece against said abrading surface; and a second polishing section having a second polishing tool and a pressing device for forcing said work surface against a rubbing surface of said second polishing tool, said second polishing tool being movable substantially in a planar translation motion relative to said work surface.

22. A polishing apparatus according to claim 21, wherein, said second polishing tool is moved substantially without relative rotation to said work surface.

* * * * *